United States Patent [19]

Johnson et al.

[11] 3,934,361

[45] Jan. 27, 1976

[54] IDLER CONSTRUCTION FOR EARTH-MOVING ELEVATOR

[75] Inventors: Clifford E. Johnson, Peoria; Dale O. Freeburg, East Peoria; John H. Hyler, Peoria, all of Ill.

[73] Assignee: Westinghouse Air Brake Company, Pittsburgh, Pa.

[22] Filed: Oct. 7, 1974

[21] Appl. No.: 512,729

[52] U.S. Cl. ..... 37/8; 74/242.1 R; 198/202

[51] Int. Cl.[2] ..... E02F 3/62; B60P 1/36

[58] Field of Search ..... 37/8; 198/202, 189; 74/242.1 R, 243 R

[56] References Cited

UNITED STATES PATENTS

| | | | |
|---|---|---|---|
| 2,789,438 | 4/1957 | Hutchinson | 74/242.1 R |
| 3,426,456 | 2/1969 | Keith et al. | 37/8 |

*Primary Examiner*—Stephen C. Pellegrino

*Attorney, Agent, or Firm*—Wolfe, Hubbard, Leydig, Voit & Osann, Ltd.

[57] ABSTRACT

An idler construction for an elevator used for earth moving purposes at the front of a scraper bowl, the elevator having a frame which extends upwardly and rearwardly from the region of the scraper blade supporting a pair of endless chains with transversely arranged flights. The chains are driven at the upper end of the frame and trained about rollers at the lower end so that the flights sweep the loosened soil backwardly into the bowl. Idler wheels are mounted upon brackets intermediate the ends of the frame members for supporting the return runs of the respective chains in a shallow apex spaced from the elevator frame, the idlers being coaxial and alined with the chains and having cylindrically surfaced rims of durable resilient material.

1 Claim, 4 Drawing Figures

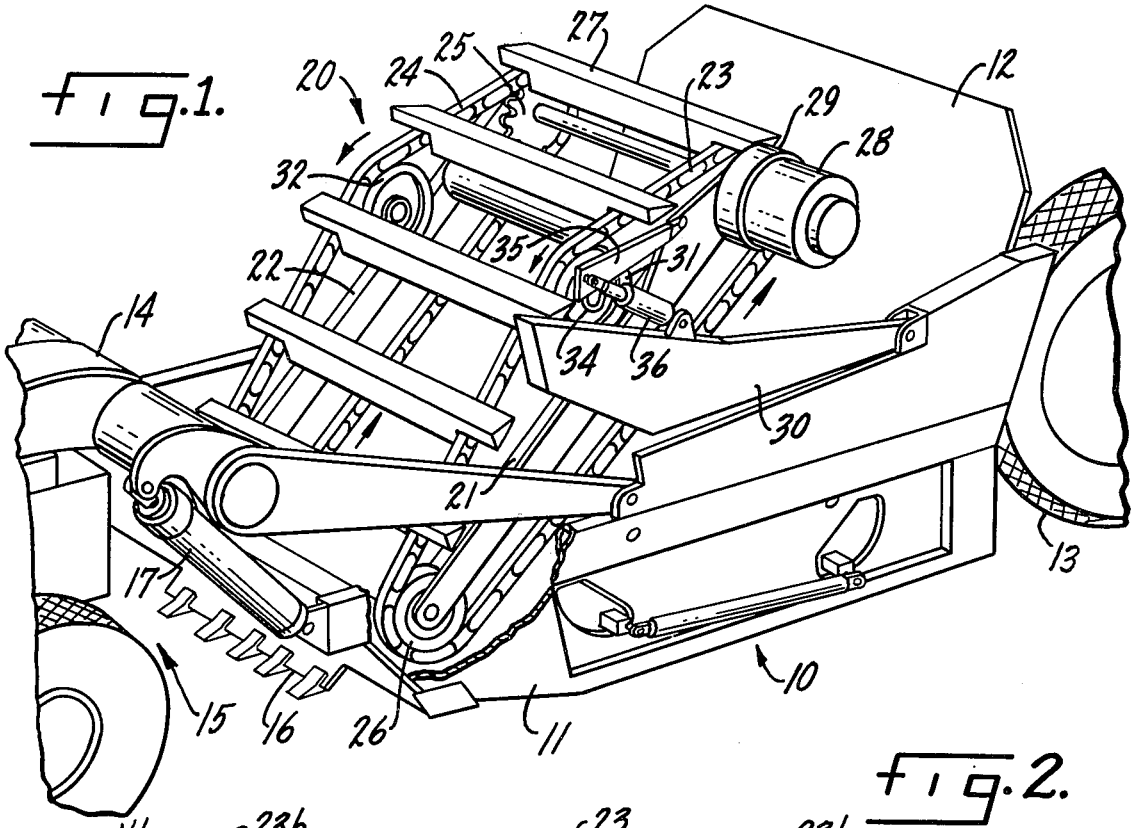
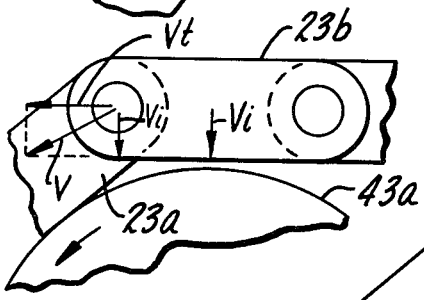
fig.4.
(PRIOR ART)
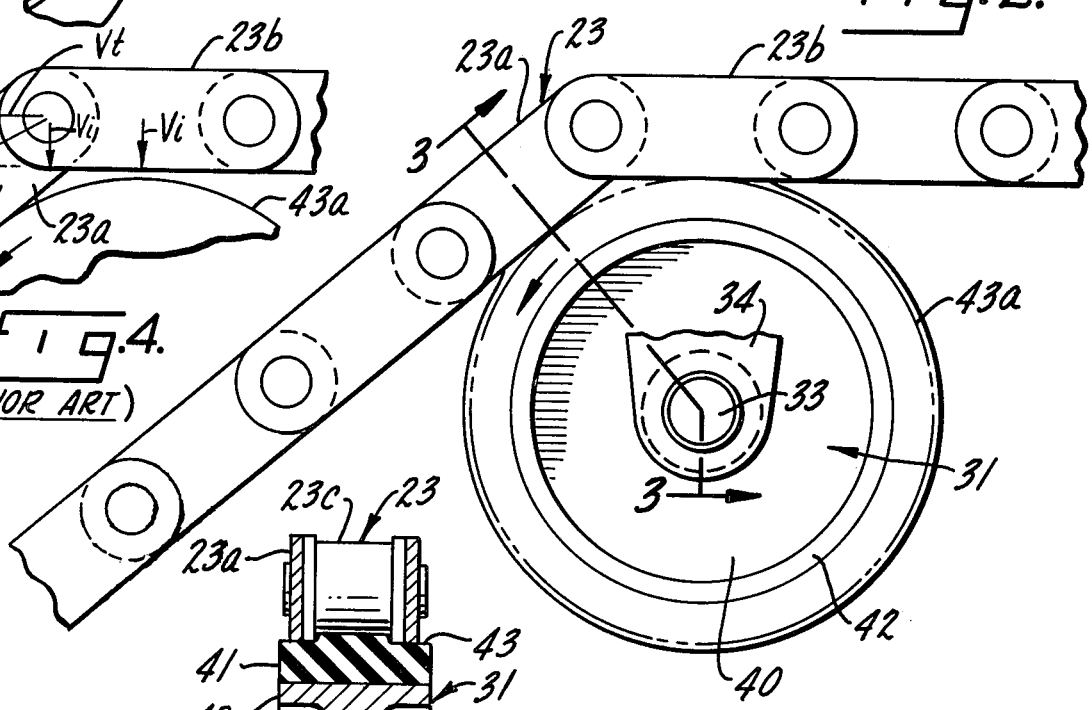
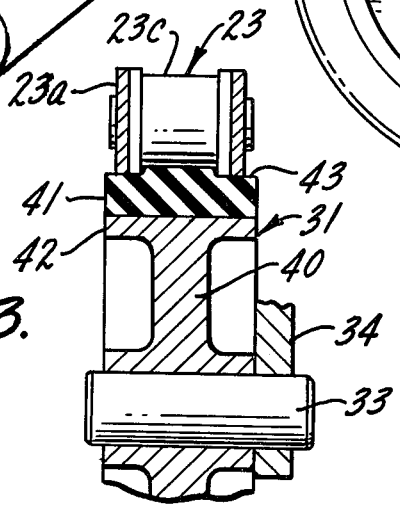
fig.3.

IDLER CONSTRUCTION FOR EARTH-MOVING ELEVATOR

BACKGROUND OF THE INVENTION

The invention relates generally to an earth moving device in the form of an elevating type scraper which has improved idler wheels for supporting and guiding the return runs of the elevator chain.

Large earth moving equipment of the scraper-elevator type is inherently noisy. It has not been generally recognized that a large portion of this noise is attributable to the hammering action of successive links of the elevator chain against the hard and inflexible surfaces of the steel idler wheels usually employed. Nor has it been generally recognized that aggravated wearing of the chain often experienced, particularly in the presence of abrasive materials handled by the scraper, is due to metallic contact at the idler.

Analysis shows that the reason for the hammering action is that the pitch of the chain, that is, the distance between adjacent pins is large as compared to the radius of the idler, indeed, in some designs approaching, or even exceeding the idler radius. Thus the chain instead of smoothly following the idler contour engages the idler in a series of abruptly angled chords. Because of this "chordal effect", each link causes the following one to be drawn with a large "lateral" velocity component against the surface of the idler which, at a high chain speed, releases a substantial energy of impact, resulting in the aforementioned noise and aggravated wear.

Since it is desired to retain a shallow apex angle for reasons of compact and efficient design, it is not possible to make the idler wheels of appreciably larger size.

SUMMARY OF THE INVENTION

It is, accordingly, an object of the present invention to provide idler wheels which are rimmed with a thick layer of durable, resilient material presenting a cylindrical surface to the chain for increasing the area of contact and for cushioning and absorbing the energy of impact quietly and without detectable wear even in the presence of abrasive materials such as sharp sand and gravel.

Other objects and advantages of the invention will become apparent upon reading the attached description and upon reference to the drawings in which:

BRIEF DESCRIPTION OF THE DRAWINGS

FIG. 1 is a simplified perspective view of a scraper-elevator employing idler wheels constructed in accordance with the present invention.

FIG. 2 is a fragmentary elevational view showing adjacent links of elevator chain being drawn over the improved idler pulley.

FIG. 3 is a fragmentary section looking along the line 3-3 in FIG. 2.

FIG. 4 is a diagram illustrating chordal effect.

While the invention has been described in connection with a preferred embodiment, it will be understood that there is no intention to limit the invention to such embodiment and it is intended, on the contrary, to cover the various alternative and equivalent constructions included within the spirit and scope of the appended claims.

DETAILED DESCRIPTION OF THE PREFERRED EMBODIMENT

Referring now to the drawing there is disclosed a scraper bowl 10 of open-fronted construction having sides 11 and a back 12, with a floor which is not visible in the drawing. The bowl is supported at the rear upon ground wheels 13 and at the front by a draft frame 14 on a tractor 15. A scraper blade 16 digs into the ground to a depth which is determined by the adjustment of a pair of bowl hoist cylinders, one of which is shown at 17.

The elevator, generally indicated at 20, encloses the open front of the bowl, extending upwardly and rearwardly from the region of the blade. The elevator has a frame including longitudinal frame members 21, 22 mounting endless elevator chains 23, 24. The chains are trained about sprockets 25 at the upper end and about rollers 26 at the lower end. Transversely extending flights 27 are secured to the chains at spaced intervals. The chain sprockets 25 are driven by a suitable motor 28 via a gear box 29. The chains are of the conventional roller type having typical links **23*a*, 23*b* with rollers 23*c*. The elevator frame is swingably supported on arms 30**, one arm only being shown.

In accordance with the present invention the roller chains are supported, in the return or downward run, and in a shallow apex, upon small diameter idler wheels which are alined with the respective runs of chain and which are generally coaxial with respect to one another, the idler wheels each having a thick rim of tough resilient material for cushioning and absorbing the impact resulting from "chordal effect". Referring to FIG. 1, the chains 23, 24 associated with the frame members 21, 22 are respectively supported upon idler wheels 31, 32 constructed in accordance with the invention. The idler wheel 31, illustrated in FIGS. 2 and 3, has a shaft 33 rotatable in a bracket 34 which is secured to an arm 35 which is pivoted to the frame member 21. To take up slack and keep the chain taut in the face of variations in loading, the arm 35 is pressed outwardly by a pressurized cylinder 36 having means (not shown) for maintaining a regulated tensioning pressure.

As shown in cross section in FIG. 3 the idler wheel includes a steel hub portion 40 and a resilient rim portion 41. The latter is preferably bonded to the hub at the junction 42 and presents a cylindrical outer surface 43 for supporting the successively engaged links of the chain 23.

It is found that for best results the rubber layer should be quite thick, say, on the order of 25% of the roller radius but in no event should it be thinner than about 10% of the roller radius. Also it is found for best results that the resilient rim should be made of material which is neither too stiff nor too soft, the preferred range of durometer rating being from 75 to 95 on the A scale.

While the term "rubber" has been used for convenience it will be understood that such term is not limited to natural rubber but includes synthetic rubber or rubber-like plastics combining toughness with resiliency. The polyurethane plastics, for example, are usable in the present application, but nylon, although adequately tough and durable, does not have a sufficiently low spring rate for best results.

The improvement brought about by use of a resilient rubber rim may be visualized by comparing FIG. 2, which shows the improved wheel, with the diagram in FIG. 4 which illustrates the impact experienced when using a conventional steel surfaced wheel. The profile of the steel wheel of equivalent nominal size is shown at 43a being repeated in dot-dash form in FIG. 2. Referring to FIG. 4, and with the chain proceeding in the direction of the arrow, a "leading" link 23*a*, assuming a chordwise position on surface 43*a*, controls the speed and direction of the subsequent or "following" link 23*b*. Thus the link 23*b* has a velocity vector V which, related to a point at the center of the link, has a tangential component $V_t$ and an impact component, at right angles thereto, $V_i$. It is the component $V_i$ which applies a hammerlike blow to the surface 43a of the steel wheel, setting up noise and vibration, creating peak forces sufficient to peen engaging metal surfaces, and producing aggravated wear in the presence of abrasive materials such as sharp sand and gravel, a common component of the soil in many regions.

By contrast in the improved construction shown in FIG. 2, the impact velocity vector simply causes local resilient deformation of the rubber surface, producing localized flattening which is apparent in the drawing thereby greatly increasing the area in contact. The energy represented by the impact velocity is progressively absorbed as the rubber is compressed and progressively released when the link, a moment later, leaves the surface of the resilient idler. Any hammering or slapping action is completely avoided and the links approach and leave the idler in silence. Not only does the cushioning completely eliminate the troublesome peak impact forces, but the force which does exist is reduced to extremely low values per unit area because of the distributed "area" contact between the links and the rubber layer rather than the "line" contact between the chain and a steel surfaced roller. Any tendency toward peening is completely eliminated. The avoidance of peak forces also results in a longer running life at the wheel shaft or bearing. A still further beneficiary of the invention is the pressure cylinder 36 which upholds the wheel 31 and which, by reason of the invention is more uniformly and lightly loaded.

Moreover wear in the presence of abrasive materials is avoided since any particles of sharp sand or gravel which tend to be wedged between the chain and the roller are simply resiliently accomodated by localized depression of the rubber in the region of the particle.

While a solid rubber rim 41, bonded to the hub, is preferred for reasons of simplicity and low maintenance, it will be understood that the invention is not limited thereto and the rubber rim may, if desired, be in the form of an inflated "tire" having a cylindrical, outer chain-supporting surface and having resilient characteristics falling within the same effective range of durometer rating.

The invention is particularly intended for use in combination with chains having links in which the pitch of the chain, that is, the distance between pin centers is of a length which is approximately equal to or approaches the radius dimension of the idler. By "approaches" is meant that the pitch is more than one-half of the idler radius. The reference to "pressing" the idler wheel outwardly as used herein includes both active and passive supporting means.

What is claimed is:

1. In an earth moving elevator for use with an open-fronted, tractor-drawn scraper bowl having a frame including a pair of frame members which extend upwardly and rearwardly at the front of the bowl, and which have means at the upper end for pivoting to the bowl, a pair of endless chains consisting of straight links pinned together and carrying transversely arranged flights, the chains having drive sprockets at the upper end of the frame and trained about rollers at the lower end of the frame so that the flights sweep the soil loosened by the blade backwardly into the bowl, a pair of chain idler wheels mounted upon the respective frame members intermediate the ends thereof, the idler wheels being generally coaxial and aligned with the respective chains for supporting the latter in paths of return movement spaced from the frame members, and means for pressing the idler wheels outwardly with respect to the frame, the improvement whereby relatively small idler wheels, having a radius approximately equal to the distance between chain link pin centers, are employed while minimizing noise resulting from the hammering action of successive links of the chain against surfaces of the idler wheels and while minimizing the resulting wear of said chain and said idler wheels, consisting of each of the chain idler wheels having an endless, relatively thick and cylindrically surfaced rim of durable material having a durometer rating in the region of 75 to 95 on the A scale.

* * * * *